US009863056B2

(12) United States Patent
Chaix

(10) Patent No.: US 9,863,056 B2
(45) Date of Patent: Jan. 9, 2018

(54) DEVICE FOR ELECTROCHEMICAL TREATMENT, LOCALLY IN PARTICULAR, OF A CONDUCTOR SUBSTRATE

(71) Applicant: DALIC, Vitre (FR)

(72) Inventor: Jean Pierre Chaix, Vitre (FR)

(73) Assignee: DALIC, Vitre (FR)

( * ) Notice: Subject to any disclaimer, the term of this patent is extended or adjusted under 35 U.S.C. 154(b) by 192 days.

(21) Appl. No.: 14/404,743

(22) PCT Filed: May 31, 2013

(86) PCT No.: PCT/FR2013/051227
§ 371 (c)(1),
(2) Date: Dec. 1, 2014

(87) PCT Pub. No.: WO2013/178959
PCT Pub. Date: Dec. 5, 2013

(65) Prior Publication Data

US 2015/0184308 A1 Jul. 2, 2015

(30) Foreign Application Priority Data

Jun. 1, 2012 (FR) ..... 12 55106

(51) Int. Cl.

| | |
|---|---|
| ***C25D 5/06*** | (2006.01) |
| ***C25D 11/02*** | (2006.01) |
| ***C25D 21/10*** | (2006.01) |
| ***C25F 7/00*** | (2006.01) |

(52) U.S. Cl.
CPC ..... *C25D 21/10* (2013.01); *C25D 5/06* (2013.01); *C25D 11/02* (2013.01); *C25D 11/022* (2013.01); *C25F 7/00* (2013.01)

(58) Field of Classification Search
CPC ..... C25D 21/10; C25D 5/06; C25D 11/02; C25D 11/022; C25F 7/00
See application file for complete search history.

(56) References Cited

U.S. PATENT DOCUMENTS 2,798,849 A 7/1957 Lindsay
3,979,220 A * 9/1976 Ishiyama ..... C25D 17/00 134/10

(Continued)

FOREIGN PATENT DOCUMENTS

EP 0 158 026 10/1985
EP 0 663 461 7/1995

OTHER PUBLICATIONS

International Search Report dated Jul. 10, 2013.

*Primary Examiner* — Ciel P Thomas
(74) *Attorney, Agent, or Firm* — Gerald E. Hespos; Michael J. Porco; Matthew T. Hespos

(57) ABSTRACT

The invention relates to a device for electrochemical treatment, locally in particular, of a conductor substrate by movement across said substrate, which can be used in every position, including a head, a shaft, an electrolyte inlet and outlet each including a flexible pipe, and two peristaltic pumps mounted on the electrolyte inlet and outlet, the head of said device being removable from said shaft, the pumps being connected to a brushless motor and the device also comprising a flowmeter for adjusting and controlling the flow in the inlet portion of said head.

10 Claims, 2 Drawing Sheets

(56) References Cited

U.S. PATENT DOCUMENTS

| | | | | | |
|---|---|---|---|---|---|
| 5,116,480 | A * | 5/1992 | Palnik | C25D 5/06 | 204/206 |
| 5,571,389 | A * | 11/1996 | Kerampran | C25D 5/06 | 204/224 R |
| 5,670,034 | A * | 9/1997 | Lowery | C25D 5/04 | 204/212 |
| 2003/0226764 | A1 * | 12/2003 | Moore | B23H 5/08 | 205/640 |
| 2004/0003894 | A1 * | 1/2004 | Hsu | C25D 5/22 | 156/345.12 |

* cited by examiner

DEVICE FOR ELECTROCHEMICAL TREATMENT, LOCALLY IN PARTICULAR, OF A CONDUCTOR SUBSTRATE

BACKGROUND

1. Field of the Invention

The subject matter of the present invention is a device for electrochemical treatment, locally in particular, of a conductor substrate by movement over said substrate, usable in any position.

2. Description of the Related Art

Such a device notably enables production of metallic coatings formed electrochemically and localized surfacing or touching up on metallic surfaces. In the automotive, aeronautical or rail industry, it frequently happens that surfaces must be prepared before assembly or before another surface treatment. In these industries and in many others, including plastics and mechanical engineering, it also happens that metallic surfaces or parts suffer wear, scratching, scuffing or corrosion that justify such localized metallic retouching.

Such electrochemical treatment devices are already known, such as for example devices of the pad type, as well as devices employing electrolyte circulation chambers or cells or gels in order to avoid flows of electrolyte.

These devices nevertheless are still subject to risks of flow during treatment, related to the quality of the seal provided by the seals or during cleaning after treatment (in the case of gels), and risks linked to the uniformity of the treatment.

Accordingly, leaks of electrolyte, notably during movement of the device over the substrate, represent a real danger for the surrounding areas that must not be treated and for the operator, because of the often corrosive nature of the electrolytes used.

Moreover, there is known from the document EP 0 663 461 a device for electrochemical treatment that includes a casing provided with an opening and defining a space, an electrode disposed in this space and intended to be connected to one terminal of an electrical power supply, the conductor substrate being intended to be connected to the other terminal of this supply, and an electrolyte inlet and an electrolyte outlet, both in communication with said space.

However, this device has disadvantages in that the same tool cannot be used for different surfaces to be treated, such as plane surfaces and surfaces of convex shape.

Moreover, this device does not always make it possible to set accurately or to maintain the electrolyte flow rate that is however a decisive characteristic for the quality of the electrochemical treatment.

The objective of the present invention is therefore to alleviate the disadvantages referred to above and to propose a device for electrochemical treatment that makes it possible to obtain an improved deposition quality at the same time as being usable in different configurations of surfaces to be treated.

SUMMARY OF THE INVENTION

To this end, the present invention consists in a device for the electrochemical treatment, in particular localized, of a conductor substrate by movement over said substrate and usable in all positions, including a head, an electrolyte inlet and an electrolyte outlet each including a flexible tube, the head including a casing provided with an opening and defining a space, an electrode disposed in this space and intended to be connected to one terminal of an electrical power supply, the conductor substrate being intended to be connected to the other terminal of this supply, a portion of the electrolyte inlet and a portion of the electrolyte outlet, both in communication with said space, and a flexible absorbent material body that is not electrically conductive and is permeable to gases and to liquids, this body being in contact with said electrode and blocking said opening, projecting out of the latter, the device further including two peristaltic pumps, a first pump mounted on said electrolyte inlet and a second pump mounted on said electrolyte outlet, the flow rate of the second pump being greater than that of the first pump so as to create a reduced pressure in said space of said head, characterized in that the device further includes a handle on which said head is intended to be fixed and including a casing, a portion of the electrolyte inlet and a portion of the electrolyte outlet intended to be connected to the electrolyte inlet and electrolyte outlet portions, respectively, of said head, the head of said device being removable from said handle, said first and second pumps include two rotors provided with peripheral rollers and mounted axially on a shaft adapted to be caused to rotate by a brushless motor, the rollers of one of the rotors cooperating with the flexible tube of the electrolyte inlet and the rollers of the other rotor cooperating with the flexible tube of the electrolyte outlet, and the diameters of said rotors and/or said flexible tubes being chosen to create said reduced pressure in said space and in that the device further includes a flowmeter for adjusting and controlling the flow rate of the first pump and the flow rate of the electrolyte in the electrolyte inlet portion of said head.

The device in accordance with the invention enables electrochemical treatment of quality, thanks to the control of the flow rate of the electrolyte, whilst being usable on a great variety of surfaces to be treated.

The head of the device is arranged so that electrolyte entering the interior space of the head is in part retained by the absorbent material body with which it comes into contact, thus ensuring electrical continuity between the electrode and the conductor substrate to be treated. Moreover, because of the reduced pressure in this space, there is continuous aspiration of excess electrolyte. The electrolyte is therefore renewed continuously, which helps to dissipate heat generated by the electrochemical treatment. Moreover, and again because of this reduced pressure, there is continuous aspiration of external air throughout the mass of the absorbent material body, which limits any unwanted flow via said opening, regardless of the position of use of the device. Moreover, this aspiration of air provides partial cooling of the electrolyte heated by the application of high currents.

In accordance with one embodiment of the device of the invention, said electrolyte inlet portion of the head opens into said space in the vicinity of said absorbent material body, the electrolyte inlet portion preferably including at least one bore in the electrode and opening onto the surface of this electrode, at the level of the area of contact of the latter with said absorbent material body. As a result, as soon as it leaves the electrolyte inlet, the electrolyte arrives directly at the absorbent material body and spreads uniformly throughout the mass of this body. Furthermore, said electrolyte outlet portion of the head starts in said space, preferably in the vicinity of said absorbent material body.

The absorbent material constituting the body employed in the head of the device of the invention could notably be a material having properties of chemical resistance to the electrolyte and thermal resistance in the working temperature range (from 15° C. to 60° C.). This material should further not be a conductor of electricity and should be permeable to gases and to liquids; finally, it should be chosen so as not to scratch the substrate to be treated. It could for example be polyester wadding or a woven or non-woven textile material consisting of nylon fibers or felt.

Additionally, the electrical power supply could supply a pulsed current or a continuous current.

The shape of the front face of the electrode in contact with the absorbent material body will be chosen as a function of the applications envisaged.

For example, the front face of the electrode may be plane if the device is intended to be used to treat a surface that is plane, convex or includes an edge.

Alternatively, the front face of the electrode has a convex surface, for example a domed surface or even a right-angle section. This embodiment is particularly suitable for treating concave surfaces, for example an angle-iron.

Moreover, there may be provision for fixing the electrode to the head at two points, and thereby to improve its retention.

The head of the device is intended to be fixed to the handle, so that the respective electrolyte inlet and outlet portions of said handle and said head come into line with one another and are connected so as to form an electrolyte inlet and an electrolyte outlet passing through the head and the handle.

The fact that the head is removable from the handle of the device enables use of the same device on different types of surfaces to be treated, by changing the head of the device or by modifying its fit on the handle.

The end of the head by which it is intended to be fixed to the handle preferably has a solid surface.

The user will therefore adapt the shape and the size of the head of the device as a function of the surface to be treated.

Accordingly, in accordance with one embodiment of the invention, the head and the handle of said device are coaxial, this embodiment being particularly suitable for treating plane surfaces.

Alternatively, the head and the handle of said device form an angle between 0 and 90°. This embodiment is particularly advantageous for treating convex surfaces or surfaces featuring a bore.

The head and the handle of said device may be fixed to each other by different means known to the person skilled in the art.

In particular, the head of said device may be clipped to said handle.

In a variant, a connector may be inserted between the head and the handle, enabling modification of the inclination between the head and the handle.

There may be provision for the end of the head intended to be fixed to the handle to be solid and for connectors for the two electrolyte inlet and outlet portions to project.

In accordance with a preferred embodiment of the invention, the device further includes an air inlet filtration and regulation (FRL) device.

Such an FR device enables further improvement of cooling of the electrolyte by the Venturi effect.

In fact, if the device in accordance with the invention is used to carry out electrolytic deposition or during an anodization operation, the temperature of the electrolyte is decisive for the quality of the layer formed on the surface to be treated.

Using an FR device ensures a clean and pressure-regulated supply of air, which makes it possible to avoid briefly shutting down the device (to await the return to an appropriate temperature).

Moreover, the use in the device of a flowmeter and of a brushless motor for the pumps makes it possible to ensure a controlled and regular flow at the electrolyte inlet and outlet, because the absence of brushes makes it possible to avoid variations in the rotation of the pump.

In accordance with one embodiment of the invention, the device further includes a display device enabling monitoring in real time of the evolving flow rate of the electrolyte.

The device in accordance with the invention may also be accompanied by software enabling the execution of predefined treatment programs. The user will therefore have only to follow the instructions delivered on the display device to start the execution of the electrochemical treatment.

The device as defined above makes it possible to carry out all types of electrochemical treatment. It could firstly be a question of the production of an electrolytic deposit; in this case, the substrate to be treated will constitute the cathode and the electrode of the device will constitute the anode, this electrode being made of a material that is insoluble under the conditions of treatment. It may equally be a question of a demetallization treatment employing a demetallization electrolyte, the substrate to be treated being chosen as the anode and the electrode of the device as the cathode. It may finally be a question of a treatment of anodization of any substrate to be treated consisting of an oxidizable material such as aluminum, titanium and alloys thereof; in this application, the substrate to be treated will be chosen as the anode and the electrode of the device as the cathode.

The invention will be now be described in more detail with the aid of the appended drawings.

DETAILED DESCRIPTION OF THE PREFERRED EMBODIMENTS

Figure 1:
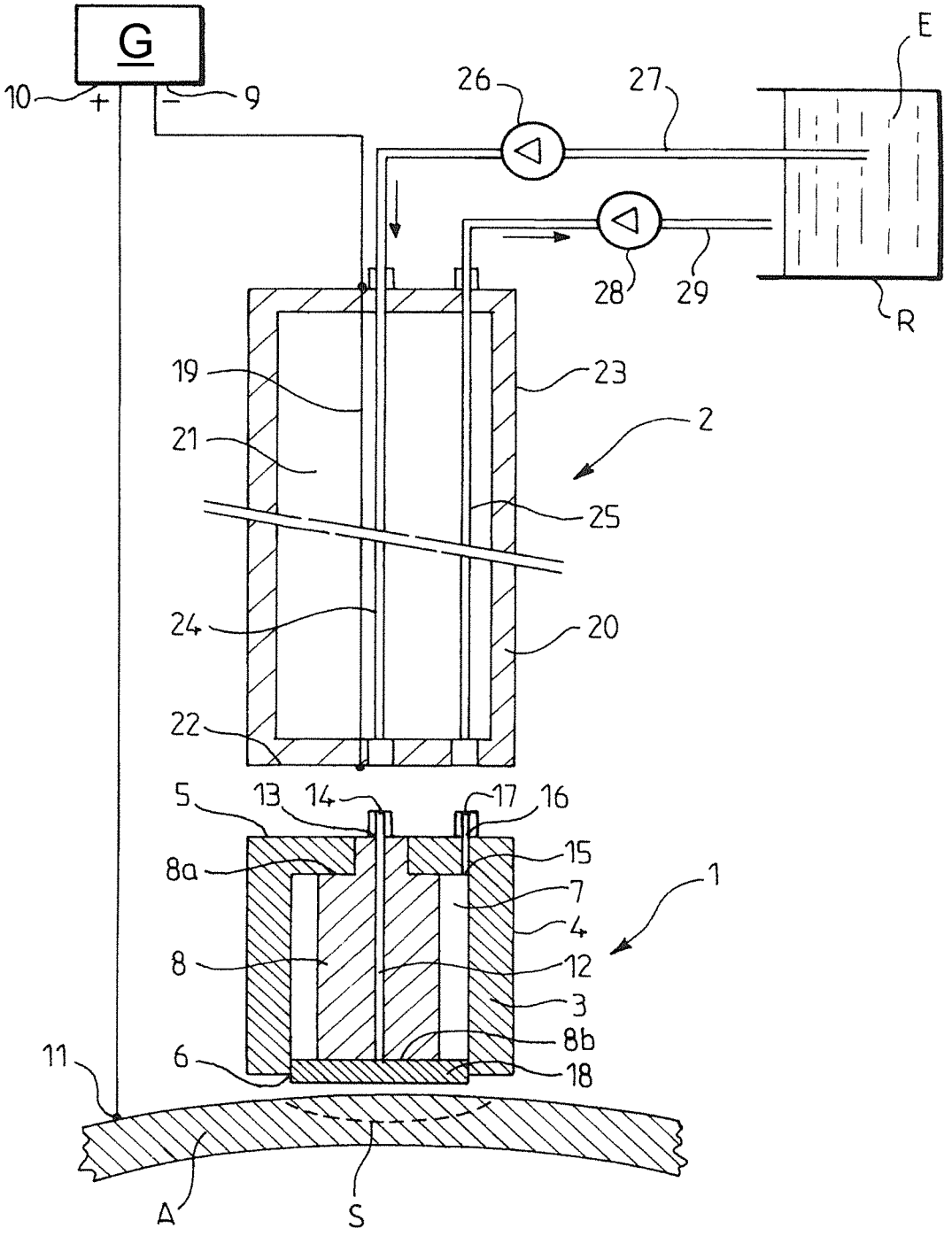
FIG. 1 represents a view in section of a device for the electrochemical treatment in accordance with the invention.

FIG. 1 represents a device in accordance with the invention for anodic oxidation enabling preparation of a surface S of an aluminum part A, before gluing.

The device includes a head 1 and a handle 2.

The head 1 includes a casing 3 having a lateral wall 4, a rear wall 5 and a front opening 6 opposite the rear wall 5. This casing defines an internal space 7 in which is housed a cathode 8 facing the opening 6.

The cathode 8 has a front face 8*b* in contact with a plane absorbent material pad 18 and may, for example, have a circular, square or rectangular cross section, the usable cathode area being variable from a few mm2 to a few cm2.

The cathode 8 is moreover retained in the space 7 by any means and notably by fixing its rear face 8*a* at at least two points to the rear wall of the casing 3. On the other hand, the cathode 8 has dimensions such that, on the one hand, it delimits with the interior face of the lateral wall 4 of the casing 3 a continuous peripheral chamber and, on the other hand, this front face 8*b* is located at a certain distance from the opening 6. Moreover, the cathode 8 is provided with a bore 12 originating on its rear face 8*a* and opening onto its front face 8*b*. Although only one bore is represented in FIG. 1, it is advantageous to provide a plurality of bores such that they open in a uniform fashion over all the front face of the cathode 8. This bore or these bores 12 are connected at the level of the rear face 8*a* of the electrode to an electrolyte inlet pipe 14 by a connector 13.

The wall 4 of the casing 3 is moreover provided with a bore 15 extending from the interior face of this wall 4 to the exterior face of the latter where it is connected by a connector 16 to an electrolyte outlet pipe 17.

The opening 6 is blocked by an absorbent material pad 18 the thickness of which is chosen so that, on the one hand, it is in contact with the whole of the front face 8*b* of the electrode 8 and, on the other hand, projects slightly out of said opening, the bore 15 being produced in such a manner that it opens into the space 7 at a point sufficiently far from the opening 4 for this point not to be covered by said pad 18.

The handle 2 of the device in accordance with the invention includes a casing 20 that defines an internal space 21, generally made of the same material as the casing 3 of the head 1, and has a front wall 22 and a lateral wall 23.

Inside the internal space 21 of the handle 2 are disposed an electrolyte inlet pipe portion 24 and an electrolyte outlet pipe portion 25 that open onto the front wall 22 of the casing 20 in such a manner as to be located respectively facing the part of the cathode 8 opening onto electrolyte inlet pipe portion 14 and electrolyte outlet pipe portion 17 of the head 1.

The internal space 21 of the handle 2 also includes a cable 19 for connection to the "minus" terminal 9 of a current generator G, notably one generating a pulsed current, the "plus" terminal 10 of which is connected to a point 11 of the part A to be treated, said cable leading onto the front wall of the casing 22 so as to be located facing the part of the rear face 8*a* of the cathode 8 opening onto the rear face of the head 1.

Accordingly, once the head 1 is fixed to the handle 2, the electrode 8 is connected to the "plus" terminal of the generator G.

Moreover, the pipe 24 is connected to the inlet of a peristaltic pump 26 the outlet of which is connected to a pipe 27 that communicate with the tank R of electrolyte E.

As for the pipe 25, it is connected to the outlet of a peristaltic pump 28 the inlet of which is connected to a pipe 29 the free end of which dips into the electrolyte in the tank R.

The peristaltic pumps 26 and 28 include two rotors provided with peripheral rollers mounted axially on a shaft adapted to be caused to rotate by a brushless motor.

Accordingly, in the event of stopping of the extraction motor of the shaft, the supply of electrolyte to the electrolytic treatment device and the evacuation of the electrolyte will be interrupted.

The flow rate of the pump 26 is controlled by a flowmeter (not represented) for setting and modifying the flow rate of the pump in real time so as to adapt it optimally to the conditions of use of the device of the invention.

The head 1 and the handle 2 are removably fixed to each other at the level of their rear wall 5 and front wall 22, respectively, by any appropriate fixing means, in particular by clipping means.

In accordance with the embodiment represented, the head 1 and the handle 2 are coaxial, but there may equally be provision for them to form an angle between 0 and 90° C.

The operation of the device so described is as follows.

After possibly degreasing the surface to be treated, the head 1 and the handle 2 are clipped to each other, after which the peristaltic pumps 26 and 28 are started. As a result, electrolyte E is aspirated from the tank R by the pump 26 and fed from the tank R via the pipe 27, the pump 26, the pipes 24 and 14 and the bore 12 onto the pad 18 which is therefore impregnated with the electrolyte. The flow rate of the pump 26, set by means of the flow meter, is chosen so that a sufficient quantity of electrolyte reaches the pad 18 in order to effect the anodic oxidation under good conditions. On the other hand, the flow rate of the pump 28 is set so as to enable the creation inside the casing 3 of a sufficiently reduced pressure without this drying out the pad 18. Because of the effect of this pump 26, the excess electrolyte and a certain quantity of air aspirated through the pad 18 are evacuated via the bore 15, the pipe 17, the pipe 25, the pump 28 and the pipe 29 to the tank R; accordingly flow of electrolyte over areas other than that to be treated is prevented.

Thereafter, the electrode 8 and the part A are connected to the current generator G. The device is then operational to effect the anodic oxidation and it suffices to move this device, manually or mechanically, over the surface S to be treated and orthogonally relative to that surface.

The thickness of the oxide layer will notably depend on the number of passes of the device over the area to be treated and the electrical parameters of the current generator G. These parameters may notably be the following:

Current type: direct current,

Voltage: 60 V,

Current: from 0 to 15 A,

Density: from 250 to 350 A/dm$^2$.

In accordance with the invention, the two pumps 26 and 28 are peristaltic pumps that include two rotors both mounted axially on a common shaft adapted to be driven in rotation by a drive motor. The rotors have rollers at their peripheries. Said pumps 26 and 28 further include a first bearing surface onto which is pressed a flexible tube connecting the pipes 14, 24 and 27 represented in FIG. 1, and a second bearing surface onto which is pressed a flexible tube connecting the pipes 17, 25 and 29 represented in FIG. 1. The rotors are disposed and sized in terms of their diameter so that their rollers compress the flexible tubes, crushing them, so that when the rotors are caused to rotate said rollers moving along the flexible tubes cause the electrolyte to move forward in those same tubes. The diameter of the rotors and/or the diameter of the flexible tubes are moreover chosen so that the flow rate at the outlet of the tube connected to the electrolyte outlet pipes is greater than that at the outlet of the tube connected to the electrolyte inlet pipes so as to create a reduced pressure inside the interior space 7.

Figure 2:
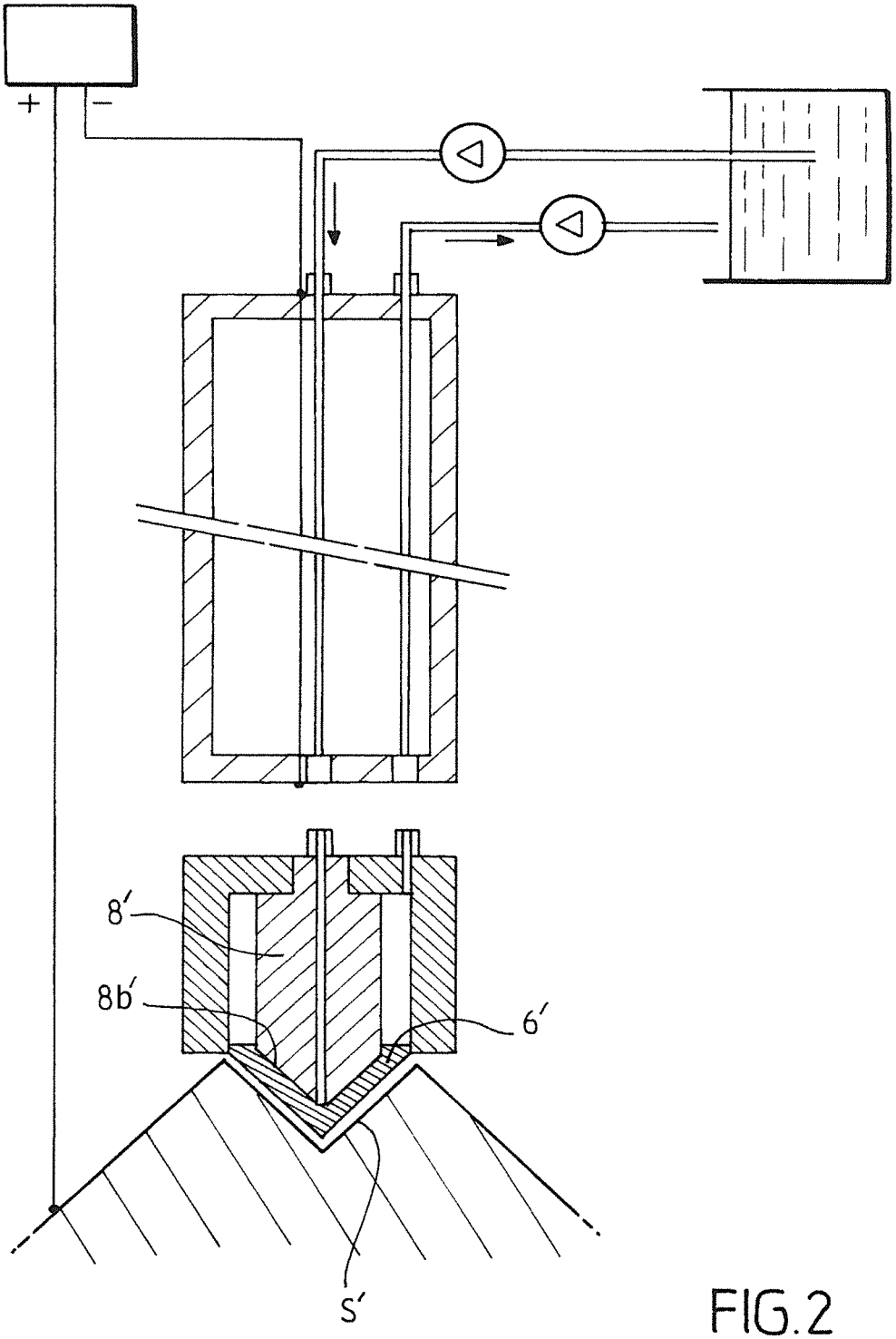
FIG. 2 represents an in section of a variant of a device for the electrochemical treatment in accordance with the invention.

FIG. 2 represents an alternative version of the device in accordance with the invention similar to that shown in FIG. 1 but in which the front face 8*b*' of the cathode 8' in contact with the pad 6' and has a right-angle section.

Accordingly, the device from FIG. 2 is particularly suitable for treating the surface S' that has an angle of 90° C.

The device in accordance with the invention is adapted to be used on parts with the most diverse shapes and volumes and is not limited to plane surfaces. Thus it may be used on surfaces to be treated that have dimensions from a few square centimeters to a few square decimeters or at the level of flat or "stepped" joints in plates; or on convex surfaces or sharp edges. The surfaces to be treated may moreover have any inclination; in particular overhead retouching is possible.

Additionally, this electrochemical treatment retouching may, in accordance with the invention, be carried out either at a fixed station in a laboratory or in a workshop or at a mobile station for working onsite. In the latter case, there will be the advantageous benefit of the total absence of flow out of the device regardless of its position (because of the reduced pressure created by the two pumps).

The invention claimed is:

1. A device for the localized electrochemical treatment of a conductor substrate, the device comprising:

a handle having a front wall with an inlet opening and an outlet opening, an inlet pipe extending through the handle to the inlet opening, an outlet pipe extending through the handle to the outlet opening, and a cable extending through the handle to a terminal at the front wall;

a head having a lateral wall with an open front end, a rear wall extending across the lateral wall at a position opposite the open front end, an electrode mounted in the head and having a rear face mounted at the rear wall of the head, a front face facing oppositely from the rear face and an outer peripheral surface spaced inward from the lateral wall of the head so that an annular space is defined between the outer peripheral surface of the electrode and the lateral wall of the head, an inlet bore extending through the electrode from the rear face to the front face, an outlet bore extending through the rear wall at a position laterally outward of the electrode and inward of the lateral wall of the head so that the outlet bore communicates with the annular space between the outer peripheral surface of the electrode and the lateral wall of the head, inlet and outlet connectors projecting from the rear wall and providing communication respectively with the inlet and outlet bores, the inlet and outlet connectors being dimensioned and disposed for removable connection to the openings in the front wall of the handle so that the terminal of the cable contacts the rear face of the electrode and so that the inlet and outlet bores of the head communicate respectively with the inlet and outlet openings of the handle;

an inlet line with an inlet pump in communication between a tank of an electrolyte and the inlet pipe of the handle;

an outlet pipe with an outlet pump providing communication from the outlet pipe of the handle; and an absorbent pad having a rear face mounted to the front face of the electrode and a front face projecting from the head, wherein the absorbent pad and the front face of the electrode have shapes selected in conformity to a shape of the conductor substrate.

2. The device of claim 1, wherein the head and the handle are coaxial.

3. The device of claim 1, wherein the head of said device can be clipped to said handle.

4. The device of claim 1, wherein the front face of said electrode in contact with the absorbent material body is planar.

5. The device of claim 1, wherein the face of said electrode in contact with the absorbent material body is convex.

6. The device of claim 1, wherein the pumps are peristaltic pumps.

7. The device of claim 1, further comprising a flowmeter for adjusting and controlling the flow rate of at least one of the pumps.

8. The device of claim 1, further comprising software enabling execution of at least one predefined electrochemical treatment.

9. The device of claim 1, wherein the inlet pump is configured to generate an inlet flow rate, and the outlet pump is configured to generate an outlet flow rate greater than the inlet flow rate.

10. The device of claim 1, wherein the head is connected non-rotatably to the handle.

* * * * *